US010461389B2

(12) United States Patent
Mukai et al.

(10) Patent No.: US 10,461,389 B2
(45) Date of Patent: Oct. 29, 2019

(54) CONVERTER AND MANUFACTURING METHOD THEREOF

(71) Applicant: KABUSHIKI KAISHA TOSHIBA, Minato-ku (JP)

(72) Inventors: Manabu Mukai, Yokohama (JP); Koh Hashimoto, Yokohama (JP); Makoto Higaki, Tokyo (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 99 days.

(21) Appl. No.: 15/639,707

(22) Filed: Jun. 30, 2017

(65) Prior Publication Data

US 2018/0053983 A1 Feb. 22, 2018

(30) Foreign Application Priority Data

Aug. 19, 2016 (JP) ..... 2016-161230

(51) Int. Cl.

| | |
|---|---|
| ***H01P 5/08*** | (2006.01) |
| ***H01P 3/06*** | (2006.01) |
| ***H01P 3/08*** | (2006.01) |
| ***H01P 11/00*** | (2006.01) |

(52) U.S. Cl.

CPC ..... *H01P 5/085* (2013.01); *H01P 3/06* (2013.01); *H01P 3/08* (2013.01); *H01P 11/003* (2013.01); *H01P 11/005* (2013.01)

(58) Field of Classification Search

CPC ..... H01P 5/085; H01P 11/005; H01P 3/06; H01P 3/08; H01P 11/003

USPC ..... 333/24 R, 33, 202, 204, 205, 206, 207, 333/222, 223, 238, 243

See application file for complete search history.

(56) References Cited

U.S. PATENT DOCUMENTS

| | | | |
|---|---|---|---|
| 5,719,354 A | 2/1998 | Jester et al. | |
| 9,054,403 B2 * | 6/2015 | Blanton | H01P 5/02 |

FOREIGN PATENT DOCUMENTS

| | | |
|---|---|---|
| JP | 2-79603 U | 6/1990 |
| JP | 8-97565 A | 4/1996 |
| JP | 2005-183890 A | 7/2005 |
| JP | 2011-187683 A | 9/2011 |
| JP | 2012-199895 A | 10/2012 |

* cited by examiner

*Primary Examiner* — Rakesh B Patel
*Assistant Examiner* — Jorge L Salazar, Jr.
(74) *Attorney, Agent, or Firm* — Oblon, McClelland, Maier & Neustadt, L.L.P.

(57) ABSTRACT

According to one embodiment, a converter includes a first dielectric substrate; a second dielectric substrate provided above the first dielectric substrate through a first adhesive layer; a first signal line provided between the first dielectric substrate and the second dielectric substrate; a first via that penetrates the first dielectric substrate and is coupled to the first signal line on an upper side of the first via; and a first conductor plate provided at least one of below the first dielectric substrate and above the second dielectric substrate.

14 Claims, 5 Drawing Sheets

CONVERTER AND MANUFACTURING METHOD THEREOF

CROSS-REFERENCE TO RELATED APPLICATIONS

This application is based upon and claims the benefit of priority from the prior Japanese Patent Application No. 2016-161230, filed Aug. 19, 2016 the entire contents of which are incorporated herein by reference.

FIELD

Embodiments relate to a converter that couples a strip line and a coaxial connector, and a manufacturing method thereof.

BACKGROUND

An antenna substrate such as a planar antenna has a laminated structure. The laminated structure includes a strip line which includes a conductor plate and a dielectric substrate, and the strip line includes a signal line inside thereof. To feed a high frequency signal into the signal line in the strip line, a coaxial-strip line converter has been proposed. This converter couples the signal line in the strip line and an internal conductor of the coaxial connector. Specifically, a through-hole penetrating the laminated structure of the strip line is provided in the laminated structure. A conductive via is provided in the through-hole. The signal line inside the strip line is electrically coupled to an internal conductor of the coaxial connector through this via.

Herein, the vicinity of a central portion of the via (between one end and the other end) is coupled to the signal line, and the one end of the via is coupled to the internal conductor of the coaxial connector. On the other hand, the other end of the via not coupled to either of the signal line or the conductor. That is, the other end of the via is formed into an open stub. The presence of the open stub increases inconsistent losses.

If a difference in thermal expansion coefficient between the dielectric substrate and the via material is large, the volume expansion due to a temperature change thereof differ between the dielectric substrate and the via material. For this reason, the via is broken due to use over a long period of time, which increases transmission loss of the converter. That is, the reliability of the via degrades. This problem becomes conspicuous when the number of laminated layers (the number of dielectric substrates) of the laminated structure of the strip line is increased, and the aspect ratio of the through-hole (via) increases.

On the other hand, there is a method in which a multi-layered substrate is generated by a build-up construction method, and a via is provided partly inside the substrate. This method can prevent a problem from occurring with the open stub. However, in the build-up construction method, if, for example, PTFE (polytetrafluoroethylene) is used as a dielectric substrate, this makes manufacturing difficult and increases manufacturing costs.

DETAILED DESCRIPTION

Figure 1:
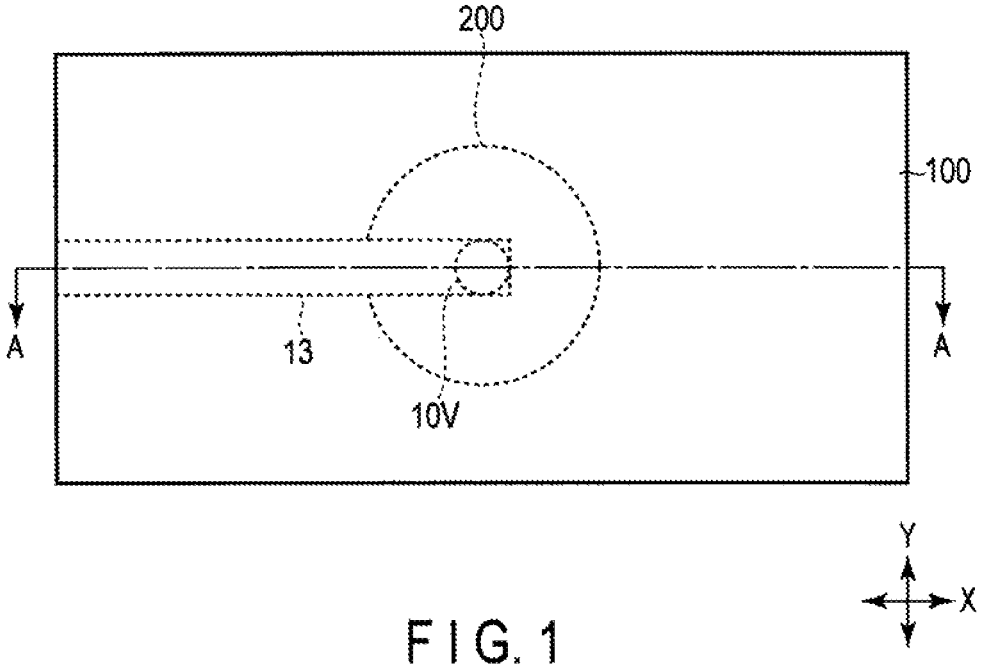
FIG. 1 is a plain view showing a converter according to a first embodiment.

In general, according to one embodiment, a converter includes a first dielectric substrate; a second dielectric substrate provided above the first dielectric substrate through a first adhesive layer; a first signal line provided between the first dielectric substrate and the second dielectric substrate; a first that penetrates the first dielectric substrate and is coupled to the first signal line on an upper side of use first via; and a first conductor plate provided at least one of below the first dielectric substrate and above the second dielectric substrate.

Hereinafter, embodiments will be described with reference to the drawings. In the drawings, identical reference numbers are provided to identical parts.

First Embodiment

Hereinafter, a converter according to the first embodiment will be described with reference to FIGS. 1 to 6. In the following explanations, the converter is a coaxial-strip line converter, and a coupled portion of a coaxial line (a coaxial connector) and a strip line will be explained.

(Configuration of First Embodiment)

Figure 2:
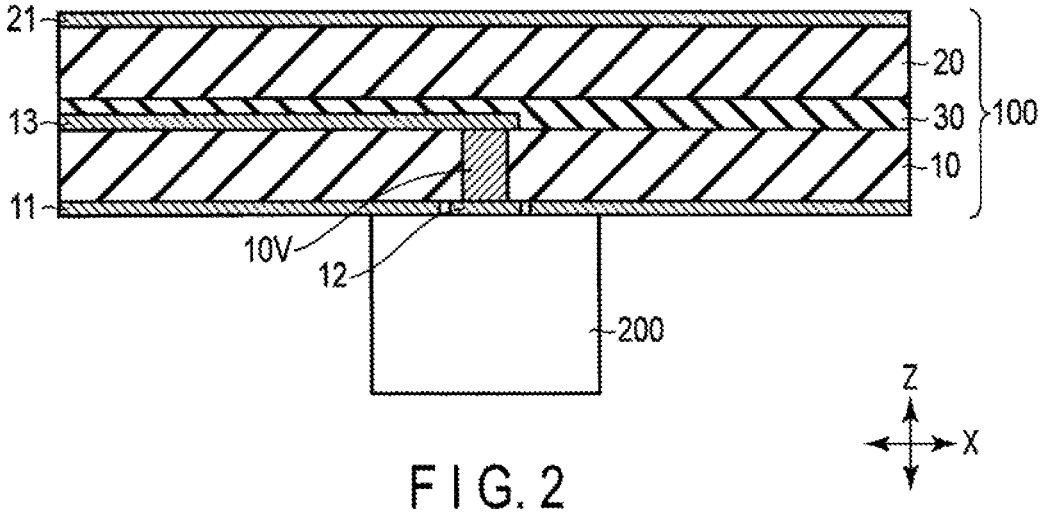
FIG. 2 is a cross-sectional view showing the converter according to the first embodiment.

FIG. 1 is a plain view showing a converter according to a first embodiment. FIG. 2 is a cross-sectional view showing the converter according to the first embodiment taken along A-A line shown in FIG. 1.

In the following explanations, above indicates an upper side in the Z direction, and below indicates a lower side in the Z direction. An upper surface indicates a surface on the upper side in the Z direction, and a lower surface indicates a surface on the lower side in the Z direction. The vertically structured relationship between them may be reversed.

As shown in FIGS. 1 and 2, the converter according to the first embodiment includes a laminated structure 100 and a coaxial connector 200.

A coaxial connector 200 includes an unillustrated internal conductor, an external conductor, and a conductive material therebetween. The internal conductor has a cylindrical shape extending in the Z direction. The external conductor has a cylindrical shape extending in the Z direction and covers the internal conductor and the circumference of the dielectric material. The external conductor is grounded to prevent leakage of a high-frequency signal from the internal conductor to the outside.

The laminated structure 100 is, for example, a planar antenna, and includes a strip line. The laminated structure 100 includes dielectric substrates 10 and 20. The dielectric substrates 10 and 20 are flat plates extending, respectively, in the X direction and in the Y direction. The dielectric substrates 10 and 20 are laminated in the Z direction.

A conductor plate 11 is provided on a lower surface of the dielectric substrate 10. The conductor plate 11 is a flat plate extending in the X direction and in the Y direction. The conductor plate 11 is grounded and prevents a leakage of wireless signals (a high-frequency signal, and a high-frequency current) from a signal line 13 to the outside. The signal line 13 is provided on an upper surface of the dielectric substrate 10. The signal line 13 is in the form of a line extending in the X direction. The signal line 13 is coupled, for example, to an unillustrated radiation element. The signal line 13 includes a dielectric material and propagates a high-frequency signal.

A via 10V that penetrates the dielectric substrate 10 is provided in the dielectric substrate 10. The via 10V is a cylindrical conductor. The via 10V is coupled to the signal line 13 at one end (on the upper side) thereof and is coupled to a land 12 at the other end (on the lower side) thereof. The land 12 is provided in an aperture of the conductor plate 11. The land 12 is the same layer as the conductor plate 11 and is insulatively separated from the conductor plate 11. The via 10V is coupled to the internal conductor of the coaxial connector 200 through the land 12. That is, a high-frequency signal is fed from the internal conductor of the coaxial connector 200 to the signal line 13 through the land 12 and the via 10V.

A conductor plate 21 is provided on an upper surface of the dielectric substrate 20. The conductor plate 21 is a flat plate extending in the X direction and in the Y direction. The conductor plate 21 is grounded and prevents a leakage of the high-frequency signal from the signal line 13 to the outside.

The upper side (upper surface side) of the dielectric substrate 10 and the lower side (lower surface side) of the dielectric substrate 20 are bonded with an adhesive layer 30. The adhesive layer 30 is an insulator.

Note that it is sufficient to provide at least one of the conductor plates 11 and 21 corresponding to the signal line 13.

(Manufacturing Method of First Embodiment)

FIGS. 3 to 6 are views showing a manufacturing process of a converter according to the first embodiment. In the first embodiment, a via is formed for each of dielectric substrates 10 and 20.

Figure 3:
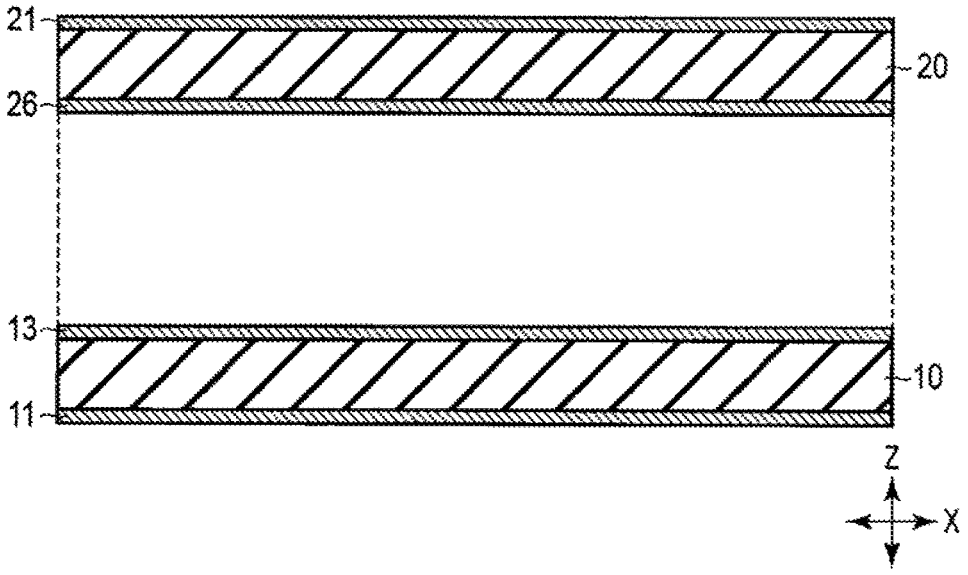
FIGS. 3-6 are views showing the manufacturing process of the converter according to the first embodiment.

First, as shown in FIG. 3, dielectric substrates 10 and 20 provided with a copper conductor plate on both surfaces thereof are used. Specifically, a conductor plate 11 is provided on a lower surface of the dielectric substrate 10, and a conductor plate 13 is provided on an upper surface of the dielectric substrate 10. Furthermore, a conductor plate 26 is provided on a lower surface of the dielectric substrate 20, and a conductor plate 21 is provided on an upper surface of the dielectric substrate 20.

Figure 4:
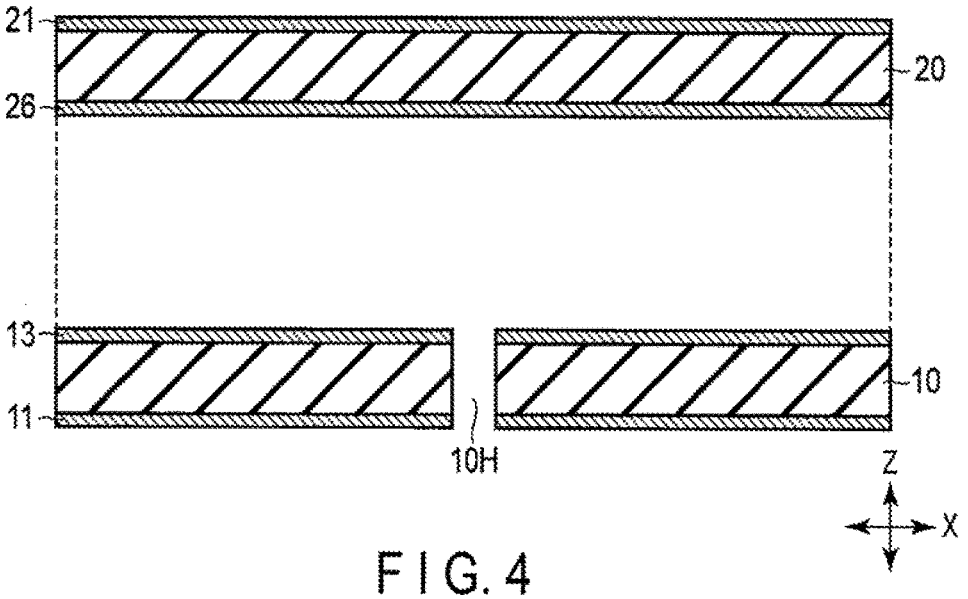

Next, as shown in FIG. 4, a hole 10H that penetrates the dielectric substrate 10 and the conductor plates 11 and 13 is formed in the dielectric substrate 10 and the conductor plates 11 and 13. The hole 10H has, for example, a cylindrical shape. The hole 10H is formed, for example, by drilling, however, the forming method is not limited thereto, and it may be formed by laser processing.

Figure 5:
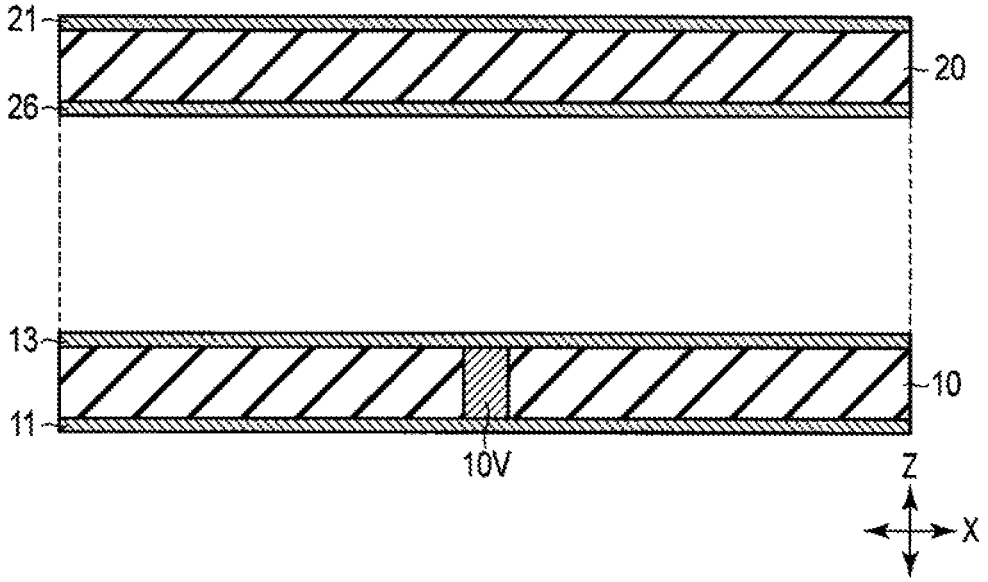

Next, as shown in FIG. 5, for example, a conductive via 10V including copper is formed inside the hole 10H of the dielectric substrate 10. The via 10V is formed, for example, by plating. In the figure, the hole 10H is filled with the via 10V, however, the configuration thereof is not limited thereto. The via 10V may be formed only in an inside surface of the hole 10H. In this case, the inside of the via 10V in the hole 10H is filled, for example, with a conductive resin or a non-conductive resin. The hole 10H may be hollow, without being filled. After that, a conductor which will become a land later is provided on both surfaces of the via 10V. This conductor is shown as a part of the conductors 11 and 13 in the drawings.

Figure 6:
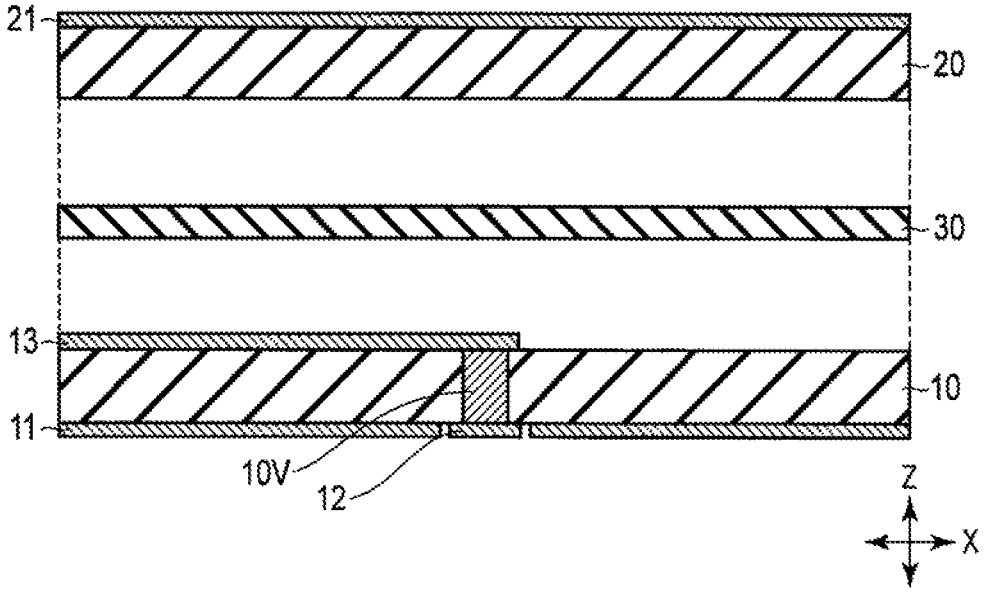

Next, as shown in FIG. 6, a conductor plate 13 provided on n upper surface of a dielectric substrate 10 is patterned by etching, thereby a signal line 13 is formed. Additionally, a conductor plate 11 provided on a lower surface of the dielectric substrate 10 is patterned by etching, thereby the conductor plate 11 and the land are insulatively separated. In this process, unnecessary portion of the conductor plate 11 may be removed by etching, as needed.

The conductor plate 26 on the lower surface of the dielectric substrate 20 is removed by etching. In this process, unnecessary portions of the conductor plate 21 on the upper surface of the dielectric substrate 20 may be removed by etching, as needed.

The order of etching of the conductor plates 11, 13, 21, and 26 is not particularly limited.

After that, the upper side of the dielectric layer 10 and the lower side of the dielectric layer 20 are bonded with an adhesive layer 30. These substrates are bonded, for example, by a hot press. In the bonding process, if the hole 10H is not filled, an adhesive layer 30 may be partly formed inside the hole 10H.

In this way, the converter according to the first embodiment is formed.

(Advantageous Effects of First Embodiment)

According to the first embodiment, the laminated structure 100 includes dielectric substrates 10 and 20. A signal line 13 is provided between the dielectric substrate 10 and the dielectric substrate 20. Then, a via 10V that penetrates the dielectric substrate 10 is provided and is located between the signal line 13 and the coaxial connector 200. That is, one end of the via 10V is coupled to the signal line 13, and the other end is coupled to the coaxial connector through a land 12. For this reason, no open stub is present above the via 10V. This can prevent the problem of inconsistent losses caused by an open stub in the prior art from occurring.

According to the first embodiment, the via 10V is provided only in the dielectric substrate 10 of the laminated structure 100. That is, the size of the via 10V in the Z direction is approximately half the size of the laminated structure 100 in the Z direction. For this reason, in the first embodiment, the aspect ratio of the via 10V is reduced, as compared to a case where the via 10V penetrates all of the laminated structure 100 in the Z direction. Therefore, the present embodiment can prevent a degradation of reliability of the via associated with an increase in aspect ratio of the via in a case where the thermal expansion coefficient of the dielectric substrate material differs from the thermal expansion coefficient of the via material.

Furthermore, according to the first embodiment, after the via 10V is formed in the dielectric substrate 10, the dielectric substrate 10 and the dielectric substrate 20 are bonded with an adhesive layer 30. For this reason, the manufacturing process is easy, and an increase in manufacturing costs can be suppressed.

Second Embodiment

Hereinafter, a converter according to a second embodiment will be described with reference to FIGS. 7 and 8. In the second embodiment, a different point from the first embodiment is that three or more dielectric substrates 10, 20, 40, and 50 are laminated (a multi-layered substrate is formed).

Note that in the second embodiment, explanations for the same points as in the first embodiment will be omitted, and mainly those different points therefrom will be explained.

(Configuration of Second Embodiment)

Figure 7:
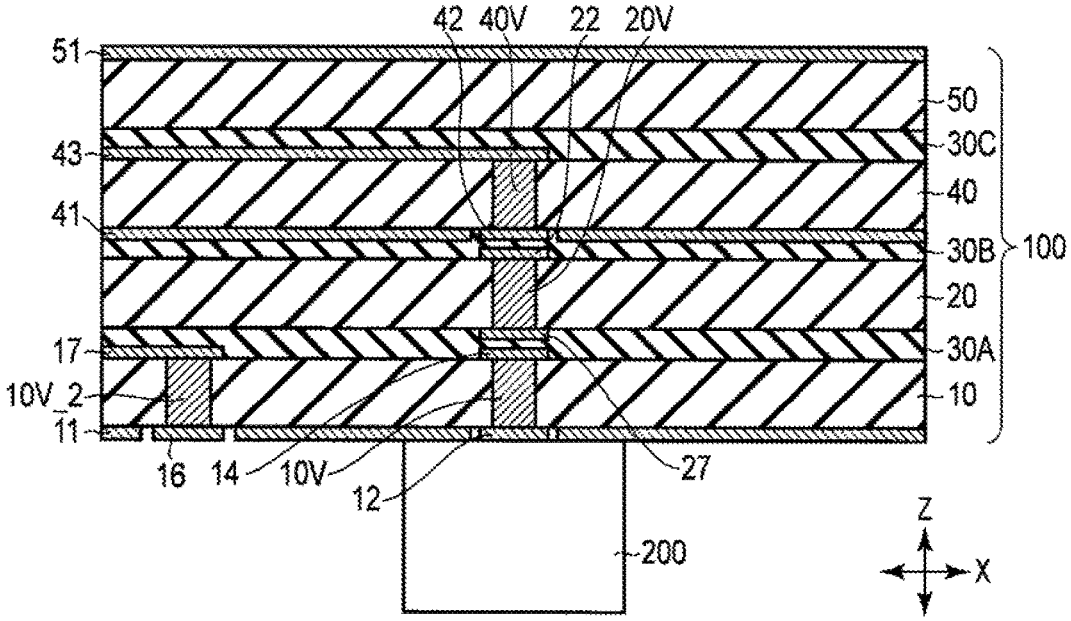
FIG. 7 is a cross-sectional view showing a converter according to a second embodiment.

FIG. 7 is a cross-sectional view showing a converter according to the second embodiment.

As shown in FIG. 7, the converter according to the second embodiment includes a laminated structure 100 and a coaxial connector 200.

The laminated structure 100 includes dielectric substrates 10, 20, 40, and 50. The dielectric substrates 10, 20, 40, and 50 are flat plates extending in the X direction and in the Y direction. The dielectric substrates 10, 20, 40, and 50 are stacked in the Z direction.

A conductor plate 11 is provided on a lower surface of the dielectric substrate 10. The conductor plate 11 is a flat plate extending in the X direction and in the Y direction. The conductor plate 11 is grounded. A via 10V that penetrates the dielectric substrate 10 is provided in the dielectric substrate 10. The via 10V is coupled to a land 14 at one end (the upper side) thereof, and is coupled to a land 12 at the other end (the lower side) thereof. The land 12 is provided at an aperture of the conductor plate 11. The land 12 is the same layer as the conductor plate 11 and is insulatively separated from the conductor plate 11. The via 10V is coupled to the internal conductor of the coaxial connector 200 through the land 12.

A via 20V that penetrates the dielectric substrate 20 is provided in the dielectric substrate 20. The via 20V is coupled to a land 22 at one end (the upper side) thereof, and is coupled to a land 27 at the other end (the lower side) thereof. The via 20V is provided at a portion corresponding to the via 10V on a plane extending in the X direction and in the Y direction. In other words, the via 20V provided at a portion where the via 10V is projected in the Z direction.

The upper side of the dielectric layer 10 and the lower side of the dielectric layer 20 are bonded with an adhesive layer 30A. The adhesive layer 30A is an insulator.

A conductor plate 41 is provided on a lower surface of the dielectric substrate 40. The conductor plate 41 is a flat plate extending in the X direction and in the Y direction. The conductor plate 41 is grounded and prevents a leakage of a high-frequency signal from the signal line 43 to the outside. The conductor plate 43 is provided on an upper surface of the dielectric substrate 40. The signal line 43 is in the form of a line extending in the X direction. The signal line 43 is coupled to, for example, an unillustrated radiation element. The signal line 43 includes a conductor and propagates a high-frequency signal.

A via 40V that penetrates the dielectric substrate 40 is provided in the dielectric substrate 40. The via 40V is coupled to the signal line 43 at one end (the upper side) thereof, and is coupled to a land 42 at the other end (the lower side) thereof. The land 42 is provided in an aperture of the conductor plate 41. The land 42 is the same layer as the conductor plate 41 and is insulatively separated from the conductor plate 41. The via 40V is provided at a position corresponding to the vias 10V and 20V on a plane extending in the X direction and in the Y direction. In other words, the via 40V is provided at a position sphere the vias 10V and 20V are projected in the Z direction.

The upper side of the dielectric layer 20 and the lower side of the dielectric layer 40 are bonded with an adhesive layer 30B. The adhesive layer 30B is an insulator.

A conductor plate 51 is provided on an upper surface of a dielectric substrate 50. The conductor plate 51 is a flat plate extending in the X direction and in the Y direction. The conductor plate 51 is grounded and prevents the leakage of a high-frequency signal from the signal line 43 to the outside.

The upper side of the dielectric layer 40 and the lower side of the dielectric layer 50 are bonded with an adhesive layer 30C. The adhesive layer 30C is an insulator.

As explained above, in the second embodiment, the vias 10V, 20V, and 40V and the lands 12, 14, 22, 27, and 42 are provided on corresponding position in a plane extending in the X direction and in the Y direction.

Herein, an adhesive layer 30A is provided between the land 14 and the land 27. That is, the land 14 and the land 27 are not directly contacted each other. For this reason, a direct current does not flow between the land 14 and the land 27. However, the inventors have found that a high-frequency signal, which is an alternating current, flows between the land 14 and the land 27. This is because a capacitor is constituted by the land 14, land 27, and the adhesive layer 30A provided between the lands, and a high-frequency signal flows by capacitive coupling of this capacitor. In the land 22, land 42, and the adhesive layer 30B provided between these lands, the same phenomenon occurs, as well. With this configuration, a high-frequency signal is fed from the internal conductor of the coaxial connector 200 to the signal line 43 through the vias 10V, 20V, and 40V and the lands 12, 14, 22, 27 and 42.

Herein, the high-frequency signal means a signal with a frequency of about 1 GHz or more.

Note that in the hot press laminating step, the adhesive layer 30A provided between the land 14 and the land 27 may rupture, and the lands 14 and 17 may be directly brought into contact with each other. Even in such a case, a high-frequency signal flows between the land 14 and the land 27. A high-frequency signal flows between the land 22 and the land 42, as well.

A signal line 17 is provided on the upper surface of the dielectric substrate 10 and is in the form of a line extending in the X direction. The signal line 17 is coupled to, for example, a not shown radiation element. The signal line 17 includes a conductor and propagates a high-frequency signal. A via 10V_2 that penetrates the dielectric substrate 10 is provided in the dielectric substrate 10. The via 10V_2 is coupled to the signal line 17 at one end (upper side) thereof and is coupled to a land 16 at the other end (lower side) thereof.

The land 16 is provided in an aperture of the conductor plate 11. The land 16 is the same layer as the conductor plate 11 and is insulatively separated from the conductor plate 11. The via 10V_2 is coupled to an internal conductor of an unillustrated coaxial connector different from the coaxial connector 200 through the land 16. That is, a high-frequency signal is fed from an internal conductor of the unillustrated coaxial connector to the signal line 17 through the land 16 and the via 10V_2.

Note that it is sufficient to provide at least one of the conductor plates 41 and 51 corresponding to the signal line 43. Similarly, it is sufficient that at least one of the conductor plates 11 and 41 corresponding to the signal 23 is provided.

(Advantageous Effects of Second Embodiment)

According to the second embodiment, the laminated structure 100 includes dielectric substrates 10, 20, 40, and 50. A signal line 43 is provided between the dielectric substrate 40 and the dielectric substrate 50. Then, a via 10V that penetrates the dielectric substrate 10, a via 20V that penetrates the dielectric substrate 20, and a via 40V that penetrates the dielectric substrate 40 are provided. The vias 10V, 20V, and 40V are located between the signal line 43 and the coaxial connector 200. One end of the via 10V is coupled to the land 12, and the other end of the via 10V is coupled to the land 14. One end of the via 20V is coupled to the land 27, and the other end of the via 20V is coupled to the land 22. One end of the via 40V is coupled to the land 42.

Herein, an adhesive layer 30A (insulator) is provided between the land 14 and the land 27. A capacitor is constituted by the land 14, land 27, and adhesive layer 30A, and thus a high-frequency signal can be flowed between the land 14 and the land 27. A high-frequency signal can be flowed between the land 22 and the land 42, as well. With this configuration, even if the number of laminated layers of the laminated structure 100 is increased, a high-frequency signal can be flowed between the signal line 43 and the coaxial connector 200 through the vias 10V, 20V, and 40V and the lands 12, 14, 21, 22, and 42. Accordingly, even if the number of laminated layers of the laminated structure 100 is increased, the same effect as in the first embodiment can be obtained.

(Modification Example of Second Embodiment)

Figure 8:
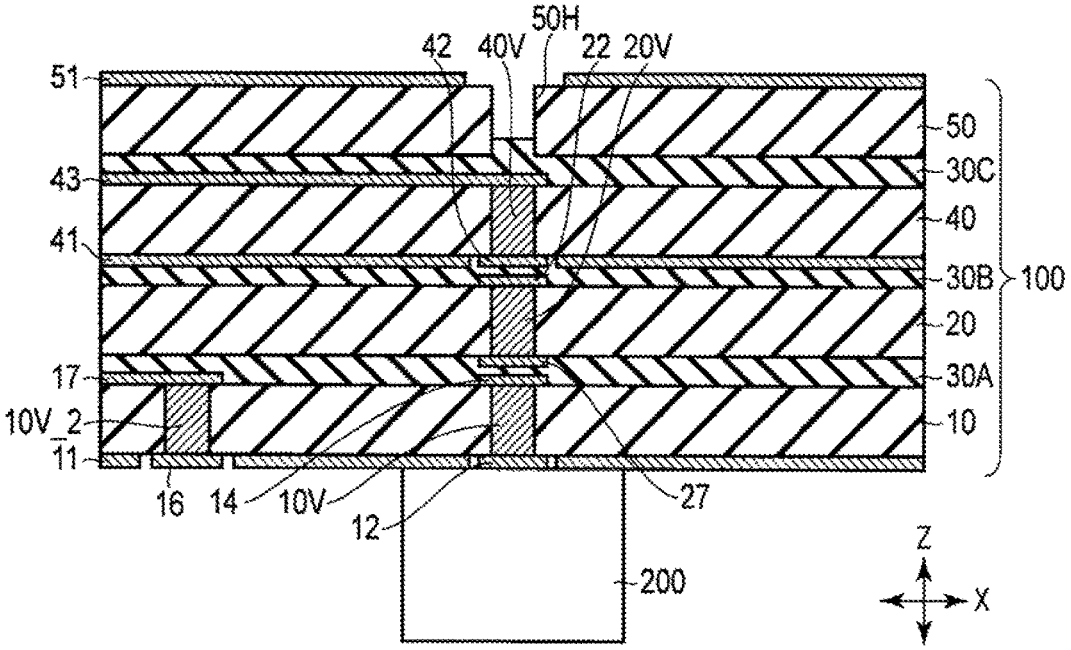
FIG. 8 is a cross-sectional view showing the converter according to the second embodiment.

FIG. 8 is a cross-sectional view showing a modification example of a converter according to the second embodiment.

As shown in FIG. 8, in the modification example, an aperture is provided in a conductor plate 51, and a hole 50H is provided in the dielectric substrate 50. The hole 50H is provided at a position corresponding to the vias 10V, 20V, and 40V on a plane extending in the X direction and in the Y direction. A part of the hole 50H is filled with an adhesive layer 30C.

In the manufacturing process, the hole 50H is formed together with holes in which the vias 10V, 20V, and 40V are to be provided. That is, at a common location of the dielectric substrates 10, 20, 40, and 50, holes are formed in a collective manner, for example, by drilling. As a result, vias are formed in the holes of the dielectric substrates 10, 20, 40, and 50. In this process, the hole 50 needs no via. For this reason, next, an aperture is formed in the conductor plate 51 by etching, and the via in the hole 50H is removed. After that, the hole 50H is partly filled with the adhesive layer 30C when the individual dielectric substrates are bonded through an adhesive layer. At this time, if the holes of the dielectric substrates 10, 20, and 40 are not filled with a via, an adhesive layer may also be formed partly inside the holes of the dielectric substrates 10, 20, and 40.

As explained above, forming the holes at a common location of the dielectric substrates 10, 20, 40, and 50 in a collective manner, by drilling, for example, facilitates the manufacturing process, making it possible to reduce the manufacturing costs.

Third Embodiment

Hereinafter, a converter according to a third embodiment will be explained with reference to FIGS. 9 and 10. In the third embodiment, a different point from the first embodiment is that vias 10VA and 20VA are further provided.

Note that third embodiment, explanations of the same points as in the first embodiment are omitted, and different points from the first embodiment will be mainly explained.

(Configuration of Third Embodiment)

Figure 9:
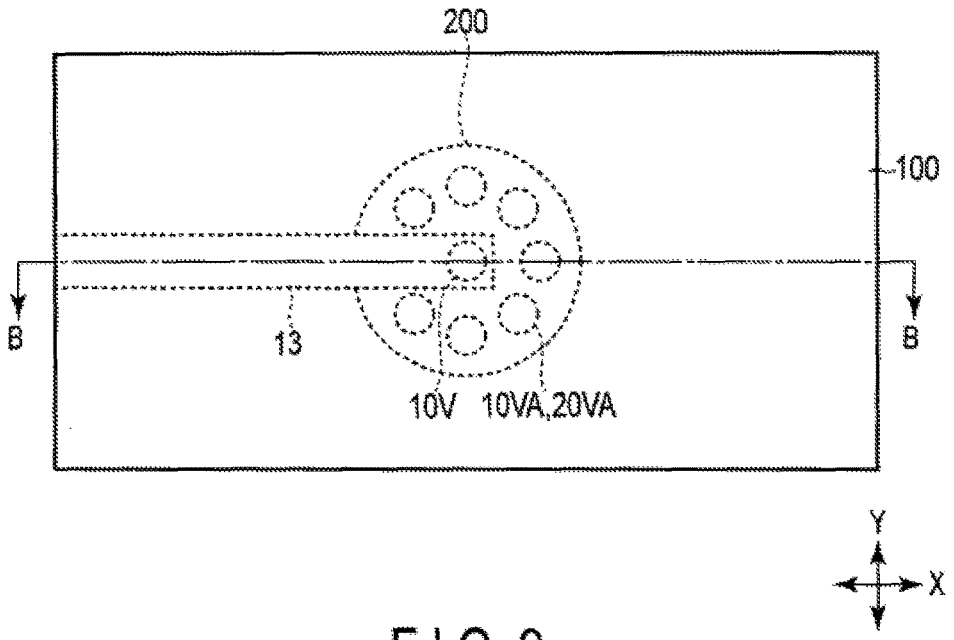
FIG. 9 is a plain view showing a converter according to a third embodiment.

FIG. 9 is a plane view showing a converter according to a third embodiment. FIG. 10 is a cross-sectional view showing the converter according to the third embodiment taken along B-B line shown in FIG. 9.

Figure 10:
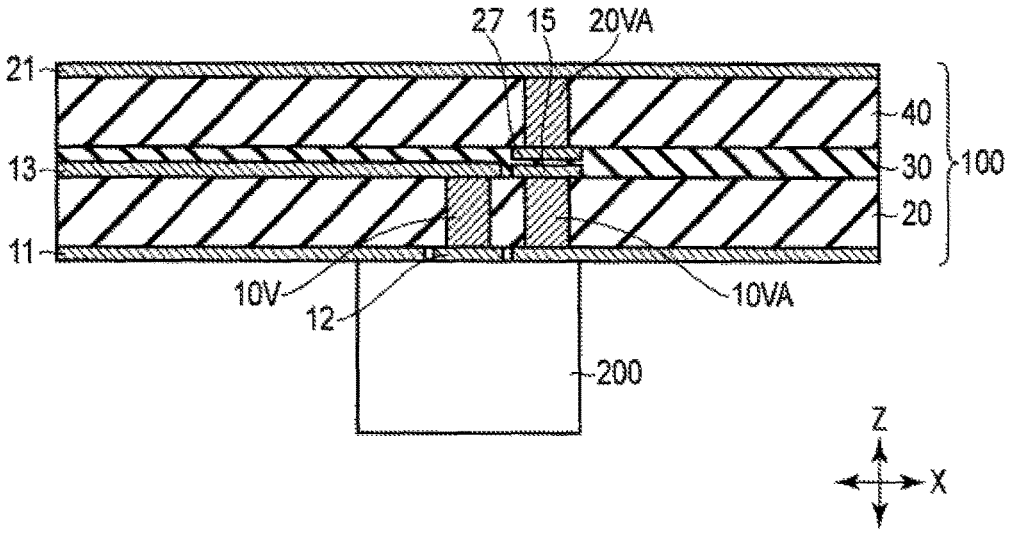
FIG. 10 is a cross-sectional view showing the converter according to the third embodiment.

As shown in FIGS. 9 and 10, a plurality of vias 10VAs that penetrate a dielectric substrate 10 are provided in the dielectric substrate 10. Each of the vias 10VA is a cylindrical conductor. Each of the vias 10VA is coupled to a land 15 at one end (the upper side) thereof and is coupled to an external conductor of the coaxial connector at the other end (the lower side) thereof through a conductor plate 11. The vias 10VA are provided so as to enclose the circumference of a via 10V in the X direction and in the Y direction.

A plurality of vias 20VA that penetrate a dielectric substrate 20 are provided in the dielectric substrate 20. Each of the vias 20VA is a cylindrical conductor. Each of the vias 20VA is coupled to a conductor 21 at one end (the upper side) thereof and is coupled to a land 27 at the other and (the lower side) thereof. Each of the vias 20VA is provided at a position corresponding to each of the vias 10VA on a plane extending in the X direction and in the Y direction.

In the formation of the vias, an adhesive layer 30 is provided between a land 15 and a land 27. That is, a high-frequency signal is flowed between the land 15 and the land 27, although the lands 15 and 27 are not directly coupled to each other. With this configuration, the high-frequency signal is fed from the external conductor (grounded) of the coaxial connector 200 to the plurality of vias 10VA and the plurality of vias 20VA. These plurality of vias 10VA and vias 20VA prevent a leakage of the high-frequency signal from the via 10 to the outside. That is, a pseudo external conductor of the coaxial connector 200 is provided for the via 10V.

(Advantageous Effects of Third Embodiment)

According to the third embodiment, a plurality of vias 10VA and a plurality of vias 20VA are provided around the via 10V. The plurality of vias 10VA and the plurality of vias 20VA are coupled to an external conductor (grounded) of the coaxial connector 200. With this configuration, a leakage of a high-frequency signal from the via 10V to the outside can be prevented.

Each of the embodiments described above may be suitably used in combination.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A converter comprising:

a first dielectric substrate;

a second dielectric substrate provided above the first dielectric substrate through a first adhesive layer;

a first signal line provided between the first dielectric substrate and the second dielectric substrate;

a first via that penetrates the first dielectric substrate and is coupled to the first signal line on an upper side of the first via;

a first conductor plate provided at least one of below the first dielectric substrate and above the second dielectric substrate;

a plurality of second vias that penetrate the first dielectric substrate and are provided around the first via;

a plurality of third vias that penetrate the second dielectric substrate and are provided at positions corresponding to the plurality of second vias; and the plurality of second vias and the plurality of third vias being mutually separated.

2. The converter of claim 1, wherein the first conductor plate is provided below the first dielectric substrate, and the plurality of second vias are coupled to an external conductor of a coaxial connector through the first conductor plate on a lower side of the second vias.

3. The converter of claim 1, further comprising:

a plurality of first lands that are formed on an upper surface of the first dielectric substrate and are coupled to the plurality of second vias; and a plurality of second lands that are formed on a lower surface of the second dielectric substrate and are coupled to the plurality of third vias.

4. A converter comprising:

a first dielectric substrate;

a second dielectric substrate provided above the first dielectric substrate through a first adhesive layer;

a third dielectric substrate provided above the second dielectric substrate through a second adhesive layer;

a first signal line provided between the second dielectric substrate and the third dielectric substrate;

a first via that penetrates the first dielectric substrate;

a second via that penetrates the second dielectric substrate, is provided at a position corresponding to the first via, and is coupled to the first signal line on an upper side of the second via;

a first conductor plate provided at least one of below the first dielectric substrate, between the first dielectric substrate and the second dielectric substrate, and above the third dielectric substrate, wherein a hole that penetrates the third dielectric substrate is provided at a position corresponding to the second via, and the hole is partly filled with the second adhesive layer.

5. The converter of claim 4, wherein the first adhesive layer is provided between the first via and the second via.

6. A converter comprising:

a first dielectric substrate;

a second dielectric substrate provided above the first dielectric substrate through a first adhesive layer;

a third dielectric substrate provided above the second dielectric substrate through a second adhesive layer;

a first signal line provided between the second dielectric substrate and the third dielectric substrate;

a first via that penetrates the first dielectric substrate;

a second via that penetrates the second dielectric substrate, is provided at a position corresponding to the first via, and is coupled to the first signal line on an upper side of the second via;

a first conductor plate provided at least one of below the first dielectric substrate, between the first dielectric substrate and the second dielectric substrate, and above the third dielectric substrate, wherein the first via and the second via are mutually separated.

7. The converter of claim 6, further comprising:

a first land that is formed on an upper surface of the first dielectric substrate and is coupled to the first via; and a second land that is formed on a lower surface of the second dielectric substrate and is coupled to the second via.

8. The converter of claim 6, wherein the first adhesive layer is provided between the first via and the second via.

9. The converter of claim 6, wherein the first via is coupled to an internal conductor of a coaxial connector on a lower side of the first via.

10. The converter of claim 6, wherein a hole that penetrates the third dielectric substrate and is provided at a position corresponding to the second via, and a part of the hole is filled with the second adhesive layer.

11. The converter of claim 6, further comprising:

a plurality of third vias that penetrate the first dielectric substrate and are provided around the first via;

a plurality of fourth vias that penetrate the second dielectric substrate and are provided at positions corresponding to the plurality of third vias; and a plurality of fifth vias that penetrate the third dielectric substrate and are provided at positions corresponding to the plurality of third vias, wherein the plurality of third vias and the plurality of fourth vias are mutually separated, and the plurality of fourth vias and the plurality of fifth vias are mutually separated.

12. The converter of claim 11, wherein the first conductor plate is provided below the first dielectric substrate, and the plurality of third vias are coupled to an external conductor of the coaxial connector through the first conductor plate.

13. The converter of claim 11, further comprising:

a plurality of third lands that are formed on an upper surface of the first dielectric substrate and are coupled to the plurality of third vias;

a plurality of fourth lands that are formed on a lower surface of the second dielectric substrate and are coupled to the plurality of fourth vias;

a plurality of fifth lands that are formed on an upper surface of the second dielectric substrate and are coupled to the plurality of fourth vias; and a plurality of sixth lands that are formed on a lower surface of the third dielectric substrate and are coupled to the plurality of fifth vias.

14. The converter of claim 11, further comprising:

a first land that is formed on an upper surface of the first dielectric substrate and is coupled to the first via; and a second land that is formed on a lower surface of the second dielectric substrate and is coupled to the second via.

* * * * *